US010094122B1

(12) United States Patent
Akbulut

(10) Patent No.: US 10,094,122 B1
(45) Date of Patent: Oct. 9, 2018

(54) AUTOMATIC WIDE ANGLE PANEL ROOF

(71) Applicant: OPTIMAL TASARIM UYGULAMA VE YAPI SISTEMLERI SAN. VE TIC. ANOMIM SIRKETI, Istanbul (TR)

(72) Inventor: Cem Akbulut, Istanbul (TR)

(73) Assignee: OPTIMAL TASARIM UYGULAMA VE YAPI SISTEMLERI SAN. VE TIC. ANOMIM SIRKETI, Istanbul (TR)

( * ) Notice: Subject to any disclaimer, the term of this patent is extended or adjusted under 35 U.S.C. 154(b) by 0 days.

(21) Appl. No.: 15/614,793

(22) Filed: Jun. 6, 2017

(51) Int. Cl.

| | |
|---|---|
| ***E04B 7/16*** | (2006.01) |
| ***E04F 10/10*** | (2006.01) |
| ***E06B 9/68*** | (2006.01) |
| ***E04D 13/17*** | (2006.01) |
| *E04F 10/08* | (2006.01) |

(52) U.S. Cl.
CPC ..... *E04F 10/10* (2013.01); *E04B 7/163* (2013.01); *E04D 13/17* (2013.01); *E06B 9/68* (2013.01); *E04F 10/08* (2013.01)

(58) Field of Classification Search
CPC . E04B 7/163; E04B 9/68; E04D 13/17; E04F 10/10; E04F 10/08
See application file for complete search history.

(56) References Cited

U.S. PATENT DOCUMENTS

| | | | | |
|---|---|---|---|---|
| 4,527,355 | A * | 7/1985 | Numakami | E04F 10/10 49/275 |
| 8,413,389 | B2 * | 4/2013 | Frigerio | E04F 10/10 52/302.1 |
| 8,756,873 | B1 * | 6/2014 | Hire | E04F 10/10 49/74.1 |
| 9,175,511 | B2 * | 11/2015 | Whytlaw | E06B 7/096 |
| 9,422,715 | B1 * | 8/2016 | Selzer | E04F 10/08 |
| 2006/0016567 | A1 * | 1/2006 | Grutzner | E04F 10/10 160/218 |
| 2014/0109955 | A1 * | 4/2014 | Papanaklis | E04B 7/166 136/251 |
| 2014/0130988 | A1 * | 5/2014 | Frigerio | E04F 10/10 160/138 |
| 2014/0175240 | A1 * | 6/2014 | Selzer | E04B 7/163 248/237 |
| 2016/0115688 | A1 * | 4/2016 | Weaver | E04B 7/163 52/473 |
| 2017/0138057 | A1 * | 5/2017 | Ventrella | E04F 10/10 |
| 2017/0226746 | A1 * | 8/2017 | Byszenski | E04F 10/10 |
| 2018/0106046 | A1 * | 4/2018 | Castel | E04F 10/0607 |

* cited by examiner

*Primary Examiner* — Beth A Stephan
(74) *Attorney, Agent, or Firm* — Abelman, Frayne & Schwab

(57) ABSTRACT

An automatic double angle motorized roof system that is applicable to restaurants, arbores, buildings, and so forth, which can be opened and can be installed to roofs. It can be used in all roof applications.

3 Claims, 7 Drawing Sheets

AUTOMATIC WIDE ANGLE PANEL ROOF

TECHNOLOGICAL AREA

This invention is applicable to restaurants, arbores, buildings, and vs. and is a double angle motorized roof system that can be opened at wide angle that automatically works on the roofs of the rooms. It can be used in all roof applications.

STATUS OF THE TECHNIQUE

In the present application of techniques, this kind of roof systems can be opened up to narrow angles or can be opened up to a vertical angle of up to 90°. In this case, when the roof is open, the entire shade of the place will change according to the position of the Sun. Shadowing will not be done when requested.

In the current techniques, due to the construction of mechanical parts its single motors operates with one-way drive.

Current techniques only perform the function of opening and closing with a right or left direction movement.

The unidirectional drive system allows the roof panel (9) to be opened without reaching the right angle.

Because they are driven from one direction, the aluminum panels are closed with their own weights.

The engine opens with motor. It has roof panels (9) that can be opened up to a small angle from 90° angle to close with its own weight. The roof panels (9) automatically close as they are driven from one direction. They can usually be opened up to 80°. In existing systems, roof panels (9) are folded back and each panel is thickened to a certain millimetric level due to the accessory and mechanical structures. As the roof closes backwards, a deposition area will not completely shut down. The stack areas in the existing techniques are quite large. In the current applications, the rear engine platform height is high; It is generally seen as 580 mm. Since they are systems with motor drive on the one hand, the steel wire which will fulfill the mechanical functions of the engine cylinders must go at certain angles. The elevation of the engine platform is increasing due to the steel wire that has to go at a certain angle Since they are driven from one direction, roof panels (9) must close with their own weights, so that roof panels (9) which need a certain inclination, provide height loss due to inclination. It causes space loss in the places they are applied.

In the current applications two motors are controlled by two separate controls. There is a control mechanism called "mechanical switch" that prevents misuse. These mechanical switches are used to protect the product if folding occurs at certain angles. But since these buttons are mechanical parts, they can lose control over time. Needs mechanical attention.

Briefly summarized, the mechanisms and problems in existing applications:

- Limitation on providing sun light protection during entire day,
- Limitation on controlling wind due to not opening in wide angle
- Due to the operation in the unidirectional system, the height problem caused by the inclination of the roof panels (9) and the restriction of wide area usage,
- The roof panels (9) can be opened to a certain extent due to the width of the retracted folding distances,
- Due to the mechanical printings in the machine for the mechanical switch, wear ratios, installation and cost, with the invention, a complete solution is provided to the above-mentioned problems. There is no problem in transferring the invention to practice.

Technical Problems the Invention is Aimed

The elimination of the drawbacks mentioned in the known state of the art, the improvement of deficiencies in existing applications and the development of foldable roof panels (9), which can be used in roof systems, for use in all alternative materials. Considering the state of the art, the objectives of the invention can be summarized as follows:

- It is aimed to protect from wind and rain
- It is aimed to reduce folding distances between wide angle openable roof panel (9) and roof panels (9).
- It is aimed to control according to the direction of the wind and shade according to all positions of the Sun.
- It is aimed to make the space covered by the roof more spacious and wide
- It is aimed to reduce installation time and costs.
- The automation system is intended to be used automatically and to prevent misuse.

EXPLANATION OF FIGURES

The description of the invention and its advantages are set forth in the accompanying drawings with reference numbers.

EXPLANATION OF REFERENCES

Figure 1:
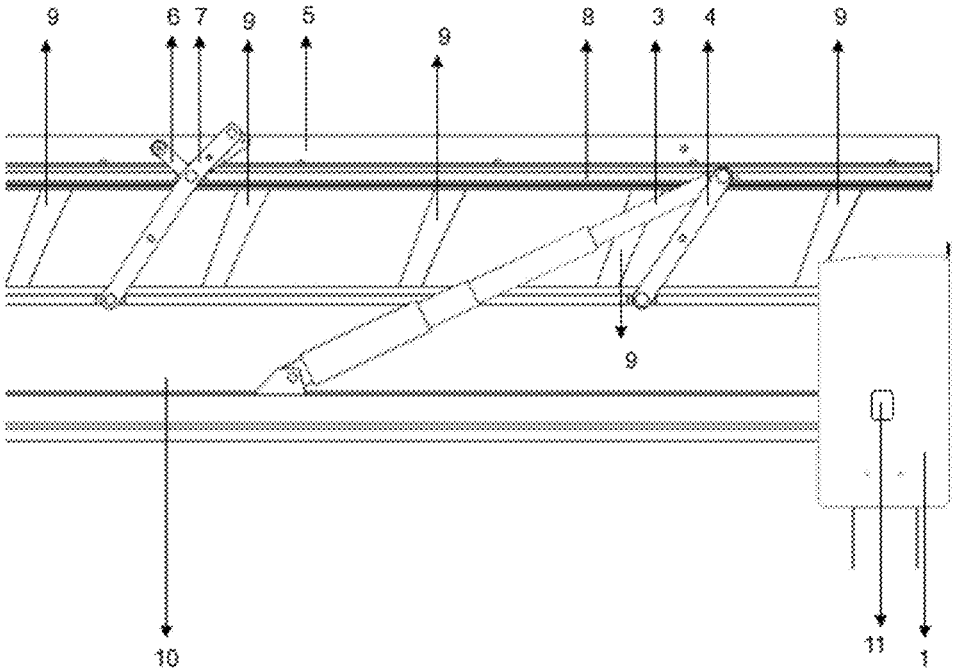
FIG. 1 The invention relates to a roof system product comprising a linear motor (3) which can be opened automatically by a wide angle and a tube motor (2) for assembly, which is backside and view.
Figure 2:
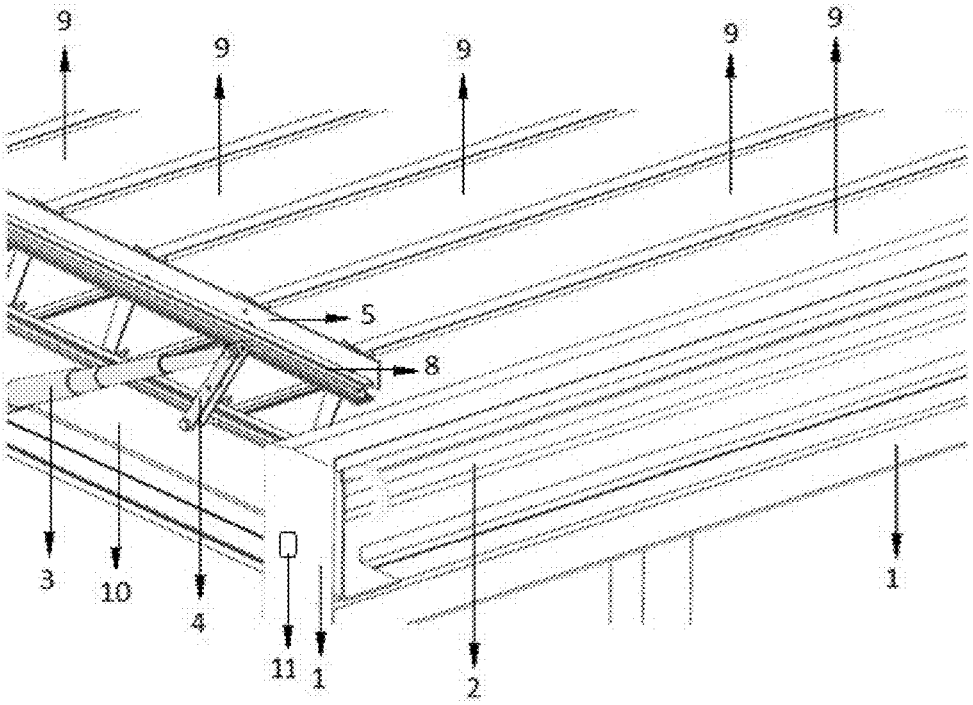
FIG. 2 The invention relates to a double-sided motor-driven roof system product which can be opened automatically in a wide angle, which is a back-cross view including the motor platform (1) being used for the collection part.
Figure 3:
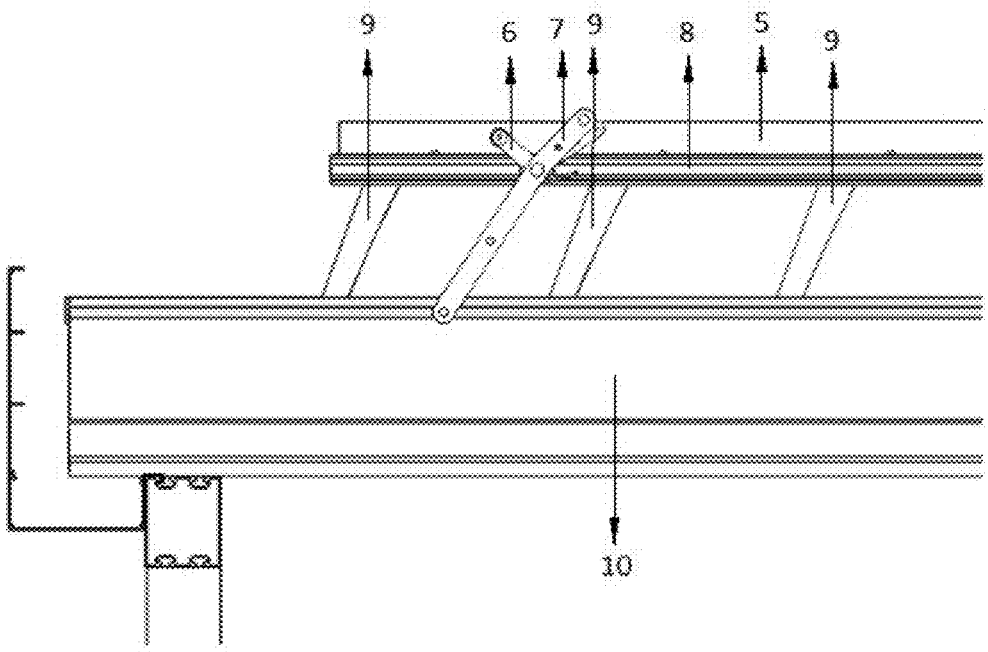
FIG. 3 The invention is a motorized roofing system product which can be opened automatically by a wide angle, which is the front view of the roof system.
Figure 4:
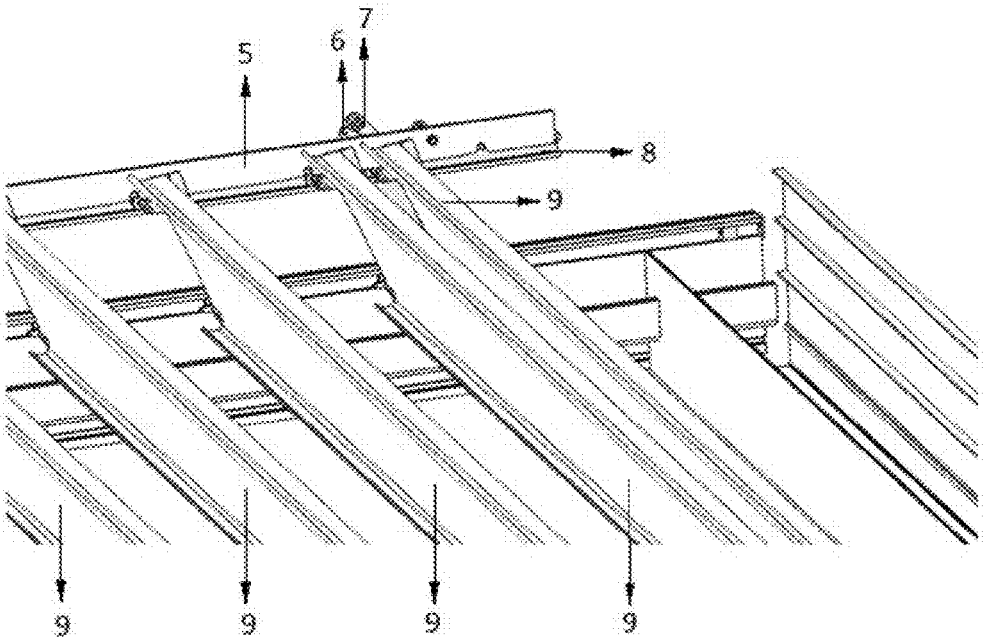
FIG. 4 The invention is a motorized roofing system product which can be opened automatically by a wide angle, which is a top cross view of the wide open and collapsed status.
Figure 5:
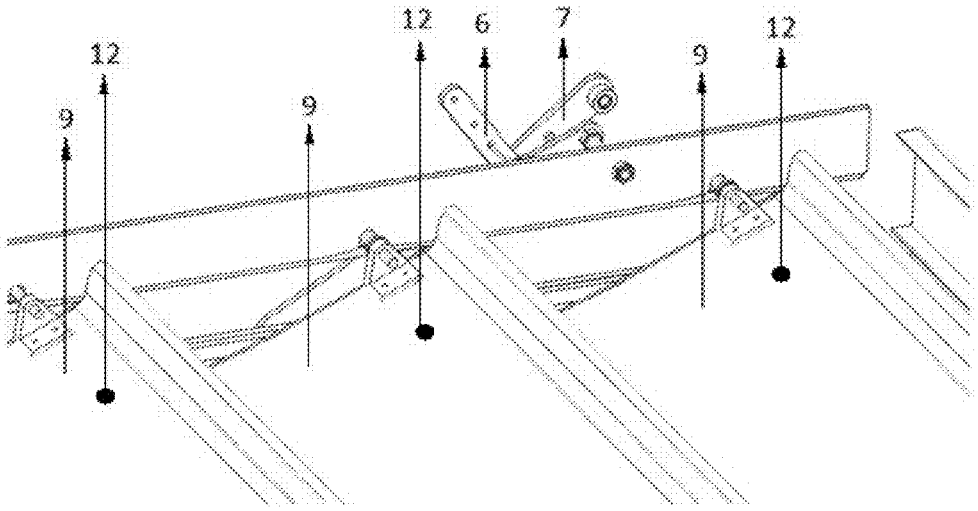
FIG. 5 The invention is a motorized roofing system product which can be opened automatically by a wide angle, which is a top cross view of the close status.
Figure 6:
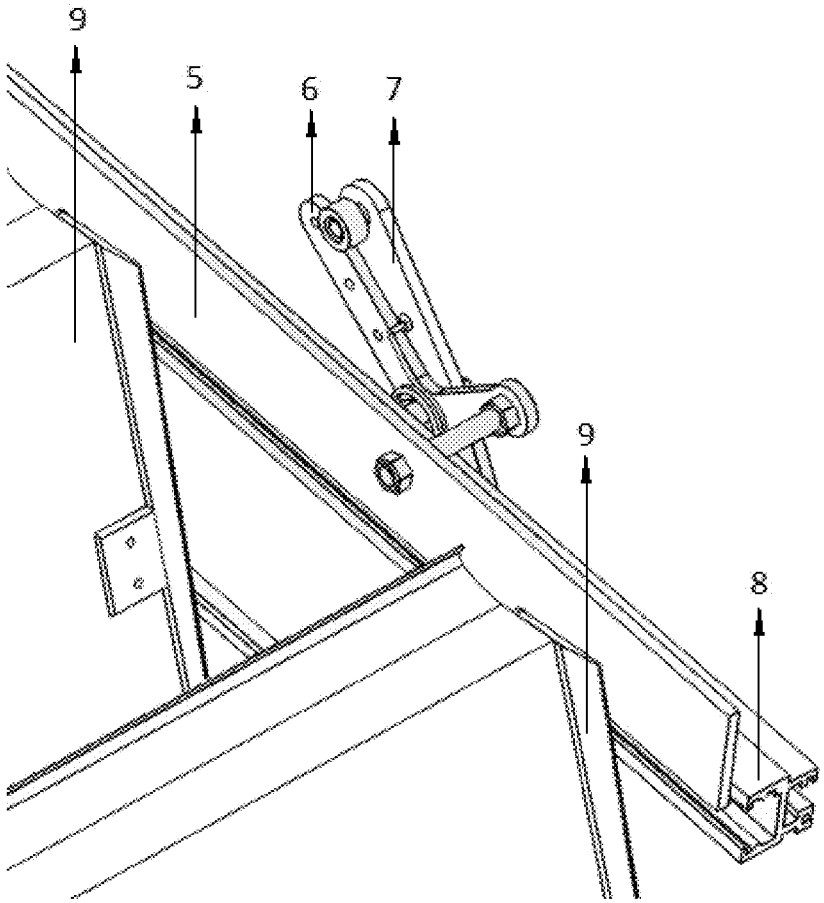
FIG. 6 The invention is a motorized roofing system product which can be opened automatically by a wide angle, which is the cross-sectional view of the mechanism that opens the top locking rail (5).
Figure 7:
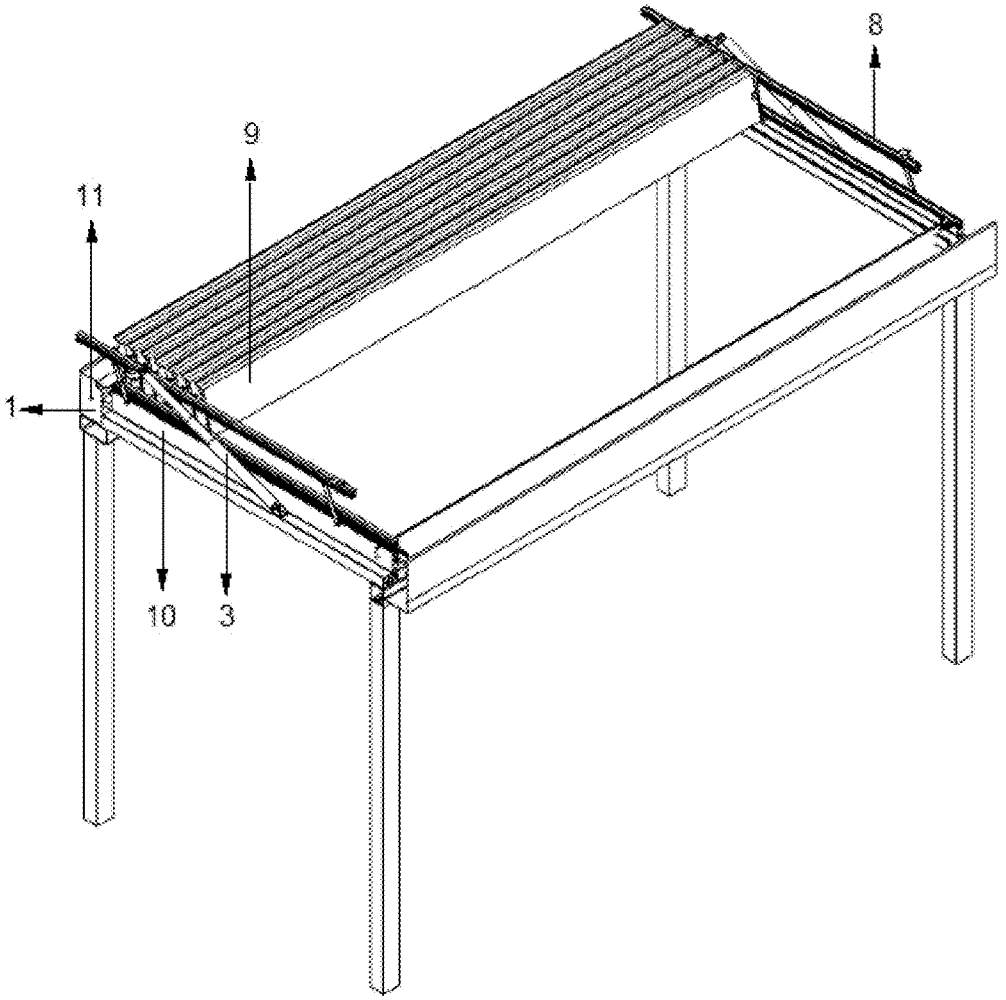
FIG. 7 The invention is a motorized roofing system product, which is the the folded status of the roof panels (9) from above.

1—Engine platform
2—Tube motor
3—Linear motor
4—Linear motor arm
5—Locking rail
6—Upper rail motion arm
7—Locking rail movement arm
8—Upper rail profile
9—Roof panel
10—Mechanical processing area
11—Modem
12—Automation system

DETAILED DESCRIPTION OF THE INVENTION

The engine platform (1) has a tube motor (2) inside. This engine is used to close and open the panels. The linear motor (3) with the movement of the upper rail, gives angle to the panels.

In the position where the linear motor (3) is the shortest, the roof panels (9) are closed and where the linear motor (3) is the longest the roof panels (9) are in 110° open stage. In this position, the roof panels (9) are collected backwards by a movement of the tube motor (2) or are opened forwards by the movement in the other direction.

The roof opening/closing movement of the roof system works in the form of a parallel edge. The parallel edge structure consisting of the mechanical processing area (10), the upper rail motion arm (6), the upper rail profile (8) and the linear motor arm (4). The parallel edge structure is used to control the roof panels (9) by 10° to 120° movement of the linear motor arm (4) and move the roof panels to 0° to 110°.

The inability to open after 90° of the known state of the art is overcome by the engagement of the upper wheels of the roof panels (9) with the upper rail profile (8) via the locking rail (5).

During the movement of the roof panels (9) between 0° and 100°, the lock rails (5) and the roof panel (9) wheels are locked in the upper rail profile (8).

After 100°, the locking rail movement arm (7) starts to be rotated by the upper rail motion arm (6). This movement allows the locking rail to be released from the upper wheels of the roof panel (9), and to release the roof panels (9) from the upper side.

During the entire opening movement, the lower wheels of the roof panels (9) are forced to stay stationary with the chains between the belt and the lower wheels on which the tube motor (2) is being pulled. In this case, the formed parallel edge structure can be transferred to the roof panels (9). During closing of the roof panels (9), the spring connected to the locking rail movement arm (7) applies a force in the closing direction to the locking rail (5). The notches on the locking rail (5) again start to hold the top wheels of the roof panels (9). The rail completely locked at 100° eliminates the known mechanical instability of the resulting technique at 90°. Since the roof panes (9) are provided with a linear motor (3) and this motor is locked even when the engine is not working, it is not necessary to install the whole roof system sloping.

The product can be operated with the help of a single remote control. A special automation system is available for this function. The automation system (12) removes the additional costs such as erroneous use which can cause installation and service charges due to improper use. The motor platform (1) is assembled with the modem (11) and placed in front of the roof panel (9).

Thanks to the software written in the integrated circuit, the opening and closing and retraction functions of the roof panels (9) can be performed automatically without mechanically moving the mechanical parts. The electronic software in the interior area sets the limit for how far backward the roof panel (9) should be pulled down. The sensor box functions in front of the panel for this purpose.

The invention claimed is:

1. A motorized roof system, comprising an engine platform (1); roof panels (9) pivotally supported on the engine platform (1) for movement between a closed position of a roof and an open position of the roof; an upper rail profile (8) secured on the engine platform (1) for supporting the roof panels (9) for displacement between the closed and open positions; a linear motor (3) located in a mechanical processing area (10) for angularly displacing the roof panels (9) from a closed position to the open position; a linear motor arm (4) connecting the linear motor (3) with the roof panels (9); an upper rail motion arm (6) connecting the linear motor arm (4) with the upper rail profile (8); a locking rail (5) for securing the roof panels (9) in a selected position on the upper rail profile (8); a tubular motor (2) supported on the engine platform (1) for displacing the roof panels (9) to the closed position thereof; and an automation system (12) for controlling operation of the motorized roof system and including a modem (11).

2. A motorized roof system according to claim 1, wherein the locking rail (5) is formed as a notched rail for providing mechanical stability.

3. A motorized roof system according to claim 1, wherein the upper rail motion arm (6) comprises a locking rail movement arm (7) for applying a closing force to the locking rail (5).

* * * * *